US008915585B1

(12) United States Patent
Ohara et al.

(10) Patent No.: US 8,915,585 B1
(45) Date of Patent: Dec. 23, 2014

(54) PRINTING APPARATUS AND PRINTING METHOD

(71) Applicant: Mimaki Engineering Co., Ltd., Nagano (JP)

(72) Inventors: Eiichi Ohara, Nagano (JP); Akira Takatsu, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 14/326,469

(22) Filed: Jul. 9, 2014

(30) Foreign Application Priority Data

Jul. 19, 2013 (JP) ..... 2013-150847

(51) Int. Cl.
*B41J 2/01* (2006.01)
*B41J 11/00* (2006.01)

(52) U.S. Cl.
CPC ..... *B41J 11/002* (2013.01)
USPC ..... 347/102; 347/101; 347/16

(58) Field of Classification Search
USPC ..... 347/102, 101, 16
See application file for complete search history.

(56) References Cited

U.S. PATENT DOCUMENTS

2003/0227527 A1* 12/2003 Richards ..... 347/102
2011/0050822 A1* 3/2011 Fujisawa et al. ..... 347/102
2012/0069109 A1* 3/2012 Anderson et al. ..... 347/102
2014/0002557 A1* 1/2014 Condello et al. ..... 347/102

OTHER PUBLICATIONS http://www.mimaki.co.jp, retrieved on Jul. 3, 2014, with corresponding English page (http://eng.mimaki.co.jp) thereof, "Mimaki Engineering Co., Ltd.".

* cited by examiner

*Primary Examiner* — Henok Legesse
(74) *Attorney, Agent, or Firm* — Jianq Chyun IP Office

(57) ABSTRACT

A printing apparatus, including: an ink jet head for ejecting ink droplets of an ultraviolet curing type ink toward a medium; a temporary curing ultraviolet light source; an irradiation setting storage section which stores ultraviolet irradiation settings of ultraviolet rays from the temporary curing ultraviolet light source to the medium; and a curing completion ultraviolet light source being for completing curing of the dots of the ink, is provided. The ink jet head performs a printing by a multi-pass method. The ultraviolet irradiation settings are set so that, regarding temperature of the region where the ink jet head ejects ink droplets in each main scanning operation in the multi-pass method, an increasing range of temperature compared with temperature at a timing of the last main scanning operation is suppressed within a temperature rising range which dot gains of the dots of the ink are substantially the same as each other.

10 Claims, 8 Drawing Sheets

Experiment Conditions

| | |
|---|---|
| Machine Used | JFX500 |
| FW | ver.1.49 |
| Gap | Photo Paper and KAPA···1.5mm |
| UV | 700mw/cm2 |

| | |
|---|---|
| Printed Width | 450mm |
| Room Temperature | about 27°C |
| Print Conditions | 600 × 600dpi 4 passes, Bidirectional Printing |

Experiment Conditions
| | |
|---|---|
| Machine Used | JFX500 |
| FW | ver.1.49 |
| Gap | 1.5mm |
| Medium | KAPA |
| UV | 700mw/cm2 |
| | |
|---|---|
| Printed Width | 300mm |
| Room Temperature | about 27℃ |
| Print Conditions | 1200 × 1200dpi<br>8 Passes, Bidirectional Printing |
FIG.3(a)
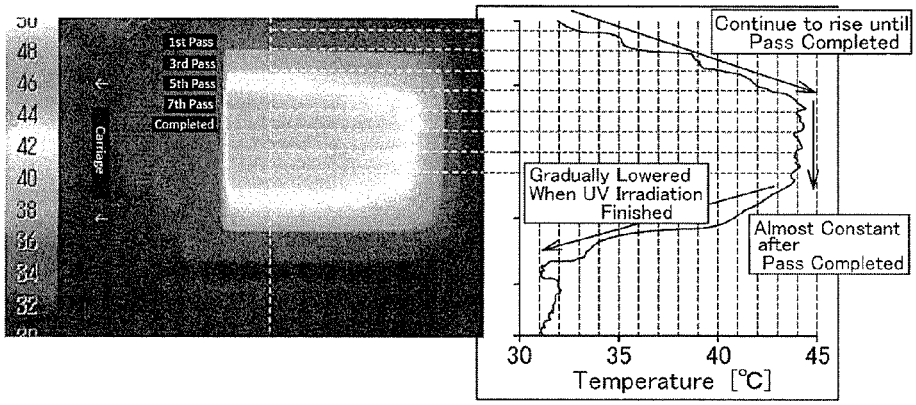
FIG.3(b)
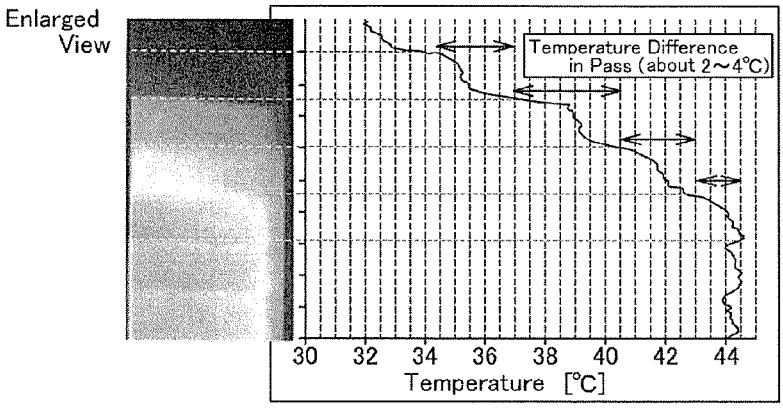
FIG.3(c)

600 × 600dpi 8-Passes Bidirectional Printing

Ink Used :X

| Medium | Print Speed | Resolution | Pass Number | Ultraviolet Irradiation Setting |
|---|---|---|---|---|
| M1 | High Speed | D1 | P1 | A1 |
| M1 | High Speed | D1 | P2 | A2 |
| M1 | High Speed | D1 | P3 | A3 |
| M1 | Low Speed | D2 | P4 | A4 |
| M1 | Low Speed | D2 | P5 | A5 |
| M1 | Low Speed | D2 | P6 | A6 |
| M2 | High Speed | D1 | P1 | B1 |
| M2 | High Speed | D1 | P2 | B2 |
| M2 | High Speed | D1 | P3 | B3 |
| M2 | Low Speed | D2 | P4 | B4 |
| M2 | Low Speed | D2 | P5 | B5 |
| M2 | Low Speed | D2 | P6 | B6 |
| ⋮ | | | | |

Ink Used :Y

| Medium | Print Speed | Resolution | Pass Number | Ultraviolet Irradiation Setting |
|---|---|---|---|---|
| M1 | High Speed | D1 | P1 | C1 |
| M1 | High Speed | D1 | P2 | C2 |
| M1 | High Speed | D1 | P3 | C3 |
| M1 | Low Speed | D2 | P4 | C4 |
| M1 | Low Speed | D2 | P5 | C5 |
| M1 | Low Speed | D2 | P6 | C6 |
| M2 | High Speed | D1 | P1 | D1 |
| M2 | High Speed | D1 | P2 | D2 |
| M2 | High Speed | D1 | P3 | D3 |
| M2 | Low Speed | D2 | P4 | D4 |
| M2 | Low Speed | D2 | P5 | D5 |
| M2 | Low Speed | D2 | P6 | D6 |
| ⋮ | | | | |

FIG.5

PRINTING APPARATUS AND PRINTING METHOD

CROSS REFERENCE TO RELATED APPLICATIONS

This application claims the priority benefit of Japan application serial no. 2013-150847, filed on Jul. 19, 2013. The entirety of the above-mentioned patent application is hereby incorporated by reference herein and made a part of this specification.

TECHNICAL FIELD

The present invention relates to a printing apparatus and a printing method.

DESCRIPTION OF THE BACKGROUND ART

Conventionally, an ink jet printer which uses an ultraviolet curing type ink for printing has been widely used (for example, see Non-patent literature 1). In such an ink jet printer, normally, ink droplets are ejected from an ink jet head toward a medium and ultraviolet rays are irradiated to the dots of ink which are formed by the ink droplets having been landed on the medium to cure the ink. Further, in recent years, since demanded print resolution and print quality become higher, printing in a multi-pass method has been widely used in which a plurality of main scanning operations is performed at each position of a printing region to be printed.

[Non-patent literature 1] Internet URL http://www.mimaki.co.jp

SUMMARY

The present inventors have executed earnest research on a structure for printing in a multi-pass method by using an ultraviolet curing type ink. Specifically, for example, printing has been actually performed under various print conditions and print qualities have been evaluated and the like.

As a result of the earnest research, the present inventors have found that, regarding printed results by respective main scanning operations in a multi-pass method (respective print passes), there may occur a difference in print quality depending on print passes. Further, as a result of the further earnest research, the present inventors have found that, regarding the difference of the print quality, more specifically, for example, a difference of dot spreading (dot gain) of ink which is formed on a medium is occurred between print passes and unevenness or the like occurs between print passes. Further, the present inventors have found that a difference of the dot gain is occurred even in one print pass.

However, when such unevenness or the like is occurred, printing with a high degree of quality may be difficult to be appropriately performed. Therefore, in a case that printing is performed in a multi-pass method by using an ultraviolet curing type ink, it is desired that printing is performed in a further appropriate method. In view of the problem described above, an objective of the present invention is to provide a printing apparatus and a printing method which are capable of solving the problem.

The present inventors have investigated various causes for resulting in the unevenness or the like between printing passes. For example, first, the present inventors have considered a possibility that temperature distribution becomes uneven within the ink jet head to occur a difference in temperature of ejected ink, which causes unevenness between printing passes.

However, as a result of the earnest research, the present inventors have found that, for example, ways of occurring unevenness between printing passes are different depending on a type of a medium. Therefore, the present inventors have considered that more important causes are existed in a portion further influenced by a type of a medium and have executed further various experiments. Further, more specifically, for example, experiments and the like have been performed in which surface temperature of a medium at the time of printing is measured by using a far infrared camera.

As a result of the experiment, for example, in a case that main scanning operations are performed by a plurality of printing passes in a multi-pass method, the present inventors have found that there may be a case that each time the main scanning operation is repeated on the same region on the medium, the temperature of the region has gradually risen. Further, the present inventors have found that the temperature rise is caused due to heat generated from a light source of ultraviolet rays. In addition, the present inventors have found that there may cause a case that a difference of a dot gain of ink is occurred between printing passes by the temperature rise. In this case, for example, polymerization heat generated by polymerization of monomer in the ink may be included as the heat generated at the time of printing. Therefore, more specifically, it is considered that influence of heat generated at the time of printing is increased by the polymerization heat in addition to the heat generated by a light source of ultraviolet rays.

In order to prevent this problem, for example, it is conceivable that, when a light quantity (for example, intensity of illumination or an integrated light quantity) of ultraviolet rays generated from an ultraviolet light source is reduced, a temperature rise occurred on a medium can be suppressed. However, in recent years, a demanded print speed is increased and thus it is required that a fixed integrated quantity of light of ultraviolet rays is irradiated to dots of ink in a short time. Therefore, for example, even when a UVLED whose heat generation is comparatively small is used as a light source of ultraviolet rays, there may be a case that influence of the heat generated from the light source is difficult to be sufficiently suppressed.

As a result of the further earnest research, the present inventors have considered to cure dots of ink in a temporarily cured state in the respective main scanning operations without curing dots of ink completely. A temporarily cured state is, for example, a state where curing has been progressed at least to a state of viscosity that blurring of ink is not occurred. Further, in this case, for example, at the stage or the like where printings have been completed through all printing passes, ultraviolet rays are further irradiated to complete curing and thus the dots of ink are cured in two steps. According to this structure, for example, a light quantity of ultraviolet rays for irradiating in the respective main scanning operations can be reduced appropriately.

Further, in this case, instead of setting conditions for irradiating ultraviolet rays in consideration of only a viewpoint of viscosity for not causing blurring of ink, the present inventors have considered to set conditions for irradiating ultraviolet rays so as not to substantially occur a temperature rise due to repeating of the main scanning operation on the same region on a medium. In order to solve the above-mentioned problem, the present invention provides the following structures.

(Structure 1)

A printing apparatus for printing in an ink jet method, comprising:

an ink jet head for ejecting ink droplets of an ultraviolet curing type ink, which is cured by ultraviolet rays, toward a medium;

a temporary curing ultraviolet light source which is an ultraviolet light source for irradiating ultraviolet rays to dots of ink formed of the ink droplets landed to the medium, the temporary curing ultraviolet light source generating ultraviolet rays for curing the dots of the ink in a temporarily cured state;

an irradiation setting storage section which stores ultraviolet irradiation settings indicating irradiation settings of ultraviolet rays from the temporary curing ultraviolet light source to the medium; and a curing completion ultraviolet light source for further irradiating ultraviolet rays to the dots of the ink in the temporarily cured state to complete curing of the dots of the ink;

wherein the ink jet head ejects ink droplets to the medium by performing a main scanning operation for ejecting ink droplets while moving in a preset main scanning direction and performs a printing to the medium by a multi-pass method in which a plurality of the main scanning operations is performed for respective positions of a printing region to be printed on the medium;

wherein the temporary curing ultraviolet light source irradiates ultraviolet rays to dots of the ink on the medium in each of the plurality of the main scanning operations based on the ultraviolet irradiation settings stored in the irradiation setting storage section; and wherein the irradiation setting storage section stores the ultraviolet irradiation settings which are set so that, regarding temperature of the region where the ink jet head ejects ink droplets in each of the plurality of the main scanning operations in the multi-pass method, an increasing range of temperature compared with temperature at a timing of the last main scanning operation is suppressed within a temperature rising range which dot gains of the dots of the ink are substantially the same as each other.

In a case structured as described above, a light quantity of ultraviolet rays irradiated in each of the plurality of the main scanning operations can be appropriately reduced by curing dots of ink in two steps. In this case, the light quantity means, for example, at least an intensity of illumination of ultraviolet rays or an integrated quantity of light. Further, in a case that ultraviolet rays are irradiated in each of the plurality of the main scanning operations for temporarily curing dots of ink, a temperature rise of the medium can be appropriately suppressed by using an ultraviolet irradiation setting which is set so as not to occur a temperature rise of the medium.

Therefore, according to this structure, for example, in a case that an ultraviolet curing type ink is used and printing is performed in a multi-pass method, a difference of a dot gain of ink can be appropriately prevented from occurring between printing passes. Further, as a result, unevenness and the like occurred between printing passes are suppressed and printing with high quality can be performed appropriately.

In the above-mentioned structure, "dot gains of the dots of the ink are substantially the same as each other" means, for example, that a difference of dot gains is set in such a state that the difference does not cause a problem in an accuracy determined depending on demanded printing quality (for example, resolution or the like). Further, regarding temperature of a medium, "an increase range of temperature compared with temperature at a timing of the main scanning operation is suppressed within a temperature rising range which dot gains of the dots of the ink are substantially the same as each other" may mean, for example, that temperature is not substantially increased. "Temperature is not substantially increased" means, for example, that temperature is not increased in a range that a purpose for preventing a difference of dot gains of ink from occurring between printing passes is attained. Therefore, for example, in addition to a case that the temperature is not increased at all, a case may be included in which a temperature rise is occurred to an extent that a difference of dot gains does not cause a problem. Further, it is preferable that the ultraviolet irradiation setting is set so that dot gains of dots of ink formed in one printing pass are substantially the same as each other.

Further, "temperature compared with temperature at a timing of the last main scanning operation is not increased" means, for example, that in respective regions of a medium, temperature of a medium at the timing when the next main scanning operation is to be performed is not increased in comparison with temperature at the timing when the last main scanning operation has been performed. Therefore, for example, even if temperature of a medium is increased to some extent just after the last main scanning operation has been performed, it may be adaptable when the temperature of the medium is lowered before the timing of the next main scanning operation. Further, "temperature in the first main scanning operation for each of respective regions of a medium compared with temperature at the timing when the last main scanning operation has been performed" may mean, for example, temperature compared with temperature before the first main scanning operation is performed.

(Structure 2)

The temporary curing ultraviolet light source cures dots of the ink in the temporarily cured state which is a state where curing of a dot of ink is progressed to at least a gelatinous state with viscosity at which blurring of the ink is not occurred even when the ink is contacted with other ink. According to this structure, for example, dots of ink are appropriately cured in a temporarily cured state and occurrence of blurring and the like can be prevented appropriately.

(Structure 3)

The irradiation setting storage section stores the ultraviolet irradiation settings for plural types of the medium which are different from each other so as to be associated with the type of each medium and, in a case that printing is to be performed on either of the plural types of a medium, the temporary curing ultraviolet light source irradiates ultraviolet rays to dots of the ink based on the ultraviolet irradiation setting stored in the irradiation setting storage section so as to be associated with the type of the medium.

In the printing apparatus, media formed of various materials may be used. Further, influence of heat generated from the temporary curing ultraviolet light source may be also different depending on a type of a medium. Therefore, according to this structure, for example, ultraviolet rays are irradiated by the temporary curing ultraviolet light source depending on a type of a medium to be used and by using further appropriate ultraviolet irradiation setting. Further, as a result, for example, a temperature rise in a medium can be suppressed further appropriately.

As the ultraviolet irradiation setting depending on a type of a medium, for example, in a case that a medium whose heat storage property is further large is to be used, it is conceivable that a light quantity of ultraviolet rays is set to be further reduced. "A medium whose heat storage property is large" means, for example, a medium whose heat insulation property on its surface is high.

(Structure 4)

The printing apparatus is capable of setting plural kinds of a print speed different from each other as a print speed for printing, the irradiation setting storage section stores ultraviolet irradiation settings for the plural kinds of the print speed different from each other so as to be associated with the respective print speeds, and the temporary curing ultraviolet light source irradiates ultraviolet rays to the dots of the ink based on the ultraviolet irradiation setting which is stored in the irradiation setting storage section so as to be associated with the print speed for printing.

According to this structure, for example, ultraviolet rays are irradiated by the temporary curing ultraviolet light source by using further appropriate ultraviolet irradiation setting associated with a print speed. Further, as a result, for example, a temperature rise in a medium can be suppressed further appropriately.

In a case that a light quantity of ultraviolet rays is set so as to be associated with a print speed, for example, when merely considering a viewpoint for curing dots of ink, it is normally conceivable that a light quantity is increased for a faster print speed. However, when a print speed is fast, time intervals when main scanning operations of a plurality of printing passes are to be performed are respectively shortened in the respective regions on a medium. Therefore, for example, in a case that a medium which is hard to radiate heat is used or the like, a degree of influence of heat generated by the temporary curing ultraviolet light source may be increased as the print speed becomes faster.

Therefore, when considered a temperature rise in a medium, there may be a case that it is preferable that an ultraviolet irradiation setting is used such that a light quantity of ultraviolet rays corresponding to a faster print speed becomes smaller. According to the above-mentioned structure, for example, a temperature rise in a medium can be suppressed further appropriately.

(Structure 5)

The printing apparatus is capable of setting plural kinds of a pass number as a pass number of printing in the multi-pass method, the irradiation setting storage section stores the ultraviolet irradiation settings for the plural kinds of the pass number different from each other so as to be associated with the respective pass numbers, and the temporary curing ultraviolet light source irradiates ultraviolet rays to the dots of the ink based on the ultraviolet irradiation setting which is stored in the irradiation setting storage section so as to be associated with the pass number for printing.

According to this structure, for example, ultraviolet rays are irradiated by the temporary curing ultraviolet light source by using a further appropriate ultraviolet irradiation setting associated with the pass number of printing. Further, as a result, for example, a temperature rise in a medium can be suppressed further appropriately.

Increase of temperature occurred by printing through a plurality of printing passes becomes larger when temperature rises occurred by respective printing passes are overlapped with each other. Therefore, regarding that a certain ultraviolet irradiation setting is used, for example, in a case that the pass number is small, a temperature rise has no problem but, on the contrary, when the pass number becomes larger, there may be a case that the temperature rise causes a problem. Therefore, in a case that an ultraviolet irradiation setting associated with the pass number is used, it may be preferable that an ultraviolet irradiation setting is used such that a light quantity of ultraviolet rays corresponding to a larger pass number becomes smaller. According to this structure, for example, a temperature rise in a medium can be suppressed further appropriately.

(Structure 6)

The irradiation setting storage section stores the ultraviolet irradiation settings associated with types of the ink to be used in the printing apparatus, and the temporary curing ultraviolet light source irradiates ultraviolet rays to the dots of the ink based on the ultraviolet irradiation setting which is stored in the irradiation setting storage section so as to be associated with the type of the ink used.

A light quantity of ultraviolet rays required to cure dots of ink in a temporarily cured state is normally different according to a type of ink. Therefore, according to this structure, for example, a further appropriate ultraviolet irradiation setting can be used depending on a type of ink used. Further, as a result, for example, a temperature rise in a medium can be suppressed further appropriately.

(Structure 7)

The temporary curing ultraviolet light source includes a plurality of independent light source parts each of which is independently capable of controlling turning on and off and its light quantity, and the irradiation setting storage section stores the ultraviolet irradiation setting for at least specifying which of the independent light source parts is turned on.

According to this structure, for example, a way of irradiation of ultraviolet rays can be appropriately adjusted so as to be associated with various ultraviolet irradiation settings. Further, as a result, for example, a temperature rise in a medium can be suppressed further appropriately.

(Structure 8)

Each of the independent light source parts includes a UVLED as a light source for generating ultraviolet rays. According to this structure, for example, a UVLED whose heat generation is smaller than that of an ultraviolet lamp or a metal halide lamp and thus heat generated by the temporary curing ultraviolet light source is appropriately reduced. Further, as a result, for example, a temperature rise in a medium caused by heat generated by the temporary curing ultraviolet light source, polymerization heat and the like is suppressed further appropriately.

Further, normally, a UVLED is capable of easily performing turning on and off in comparison with an ultraviolet lamp or a metal halide lamp. Therefore, according to this structure, for example, switching of turning on and off of the respective independent light source parts is performed appropriately.

(Structure 9)

The printing apparatus is a flat bed type printing apparatus. In this case, the printing apparatus further includes, for example, a table-shaped member (table) on which an entire medium is placed. Further, for example, a heat dissipation plate formed of metal or the like may be further provided between the table-shaped member and a medium.

In a flat bed type printing apparatus, for example, a medium is not required to convey at the time of printing and thus a medium whose thickness is large may be used. Further, for example, a board-shaped medium or the like whose heat insulation property is high may be used. In these cases, for example, the heat storage property of the medium becomes large and, as a result, influence due to heat generated by the ultraviolet light source may be easily subjected. In other words, in a flat bed type printing apparatus, for example, in comparison with a grid rolling type printing apparatus in which a rolled shaped medium is used, a medium which is hard to radiate heat may be often used.

On the other hand, when the ultraviolet irradiation setting which is set as described above is used and dots of ink are temporarily cured by the temporary curing ultraviolet light source, even in a case that a medium which is hard to radiate heat is used, a temperature rise in a medium can be suppressed appropriately. Therefore, the above-mentioned structure is further effective in a flat bed type printing apparatus. According to this structure, for example, printing is further appropriately performed on various media by a flat bed type printing apparatus.

(Structure 10)

A printing method for printing in an ink jet method, using:

an ink jet head for ejecting ink droplets of ultraviolet curing type ink, which is ink cured by ultraviolet rays, toward a medium;

a temporary curing ultraviolet light source which is an ultraviolet light source for irradiating ultraviolet rays to dots of ink formed of ink droplets landed to the medium, the temporary curing ultraviolet light source generating ultraviolet rays for curing the dots of the ink in a temporarily cured state;

an irradiation setting storage section which stores ultraviolet irradiation settings indicating irradiation settings of ultraviolet rays from the temporary curing ultraviolet light source to the medium; and a curing completion ultraviolet light source for further irradiating ultraviolet rays to the dots of the ink in the temporarily cured state to complete curing of the dots of the ink;

the printing method comprising:

making the ink jet head perform a main scanning operation for ejecting ink droplets while moving in a preset main scanning direction and thereby ink droplets are ejected to the medium;

performing a printing to the medium by a multi-pass method which performs a plurality of the main scanning operations for respective positions of a printing region to be printed on the medium;

in each of the plurality of the main scanning operations, irradiating ultraviolet rays to dots of the ink on the medium by the temporary curing ultraviolet light source based on the ultraviolet irradiation settings stored in the irradiation setting storage section; and using the ultraviolet irradiation setting which is set so that, regarding temperature of the region where the ink jet head ejects ink droplets in each of the plurality of the main scanning operations in the multi-pass method, a temperature rising range in comparison with a timing of the last main scanning operation is suppressed within a temperature rising range which dot gains of the dots of the ink are substantially the same as each other.

According to this structure, for example, similar effects to the above-mentioned "Structure 1" can be obtained.

According to the present invention, for example, in a case that printing is performed in a multi-pass method by using an ultraviolet curing type ink, printing with high quality can be appropriately performed.

BRIEF DESCRIPTION OF THE DRAWINGS

FIG. 1(*a*) shows an example of a partial structure of a printing apparatus 10 and FIG. 1(*b*) shows an example of a detailed structure of a first ultraviolet light source 14.

FIG. 2(*a*) shows experiment conditions and FIG. 2(*b*) shows results of the experiments.

FIGS. 3(*a*), 3(*b*) and 3(*c*) are views for explaining experiments in which distribution of surface temperature of a medium during printing is measured. FIG. 3(*a*) shows experiment conditions, FIG. 3(*b*) shows results of the experiment and FIG. 3(*c*) is an enlarged view showing a part in FIG. 3(*b*).

FIG. 5 is a view showing an example of a structure of ultraviolet irradiation settings.

FIG. 6(*a*) shows an example of a structure of the first ultraviolet light source 14 and FIG. 6(*b*) shows an example of a structure of an independent light source part 102 in the first ultraviolet light source 14.

DESCRIPTION OF EXEMPLARY EMBODIMENTS

Figure 1A:
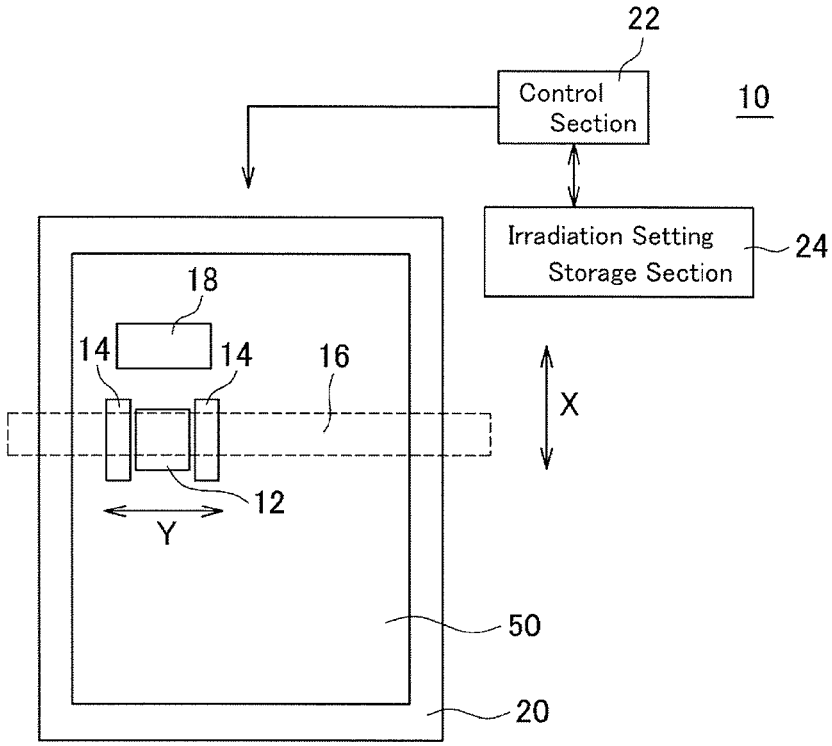
FIGS. 1(*a*) and 1(*b*) are views showing an example of a structure of a printing apparatus 10 in accordance with an embodiment of the present invention.
Figure 1B:
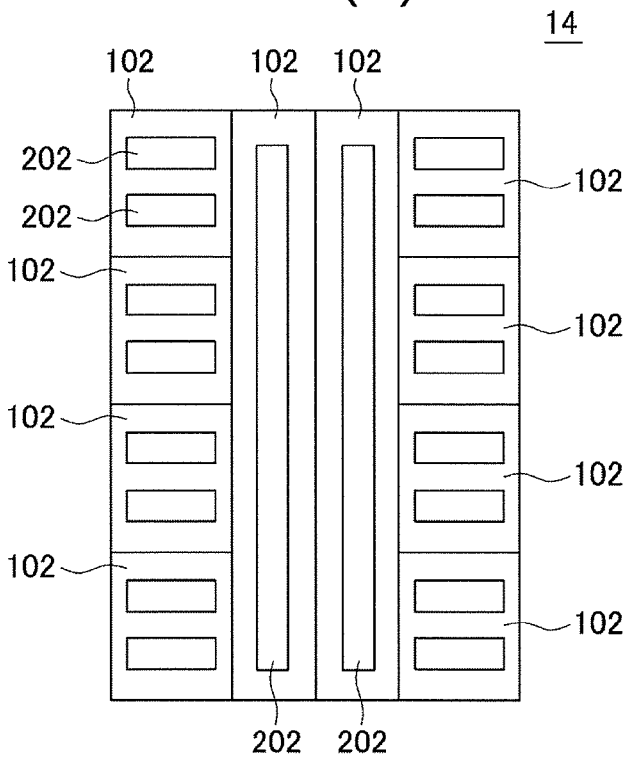

Embodiments in accordance with the present invention will be described below with reference to the accompanying drawings. FIGS. 1(*a*) and 1(*b*) are views showing an example of a structure of a printing apparatus 10 in accordance with an embodiment of the present invention. FIG. 1(*a*) shows an example of a partial structure of the printing apparatus 10.

The printing apparatus 10 may further include, for example, a structure same or similar to a publicly known ink jet printer in addition to the partial structure shown in FIG. 1(*a*). For example, the printing apparatus 10 in this embodiment may include a structure same or similar to a JFX500 type flat bed UV printer made by MIMAKI ENGINEERING CO., LTD., except a structure described below.

In this embodiment, the printing apparatus 10 is a flat bed type ink jet printer including an ink jet head 12, a first ultraviolet light source 14, a scanning drive part 16, a second ultraviolet light source 18, a table part 20, a control section 22 and an irradiation setting storage section 24. The ink jet head 12 is a print head for ejecting ink droplets of an ultraviolet curing type ink, which is cured by ultraviolet rays, toward a medium 50. The ink jet head 12 ejects ink droplets to the medium 50 by performing a main scanning operation in which ink droplets are ejected while the ink jet head 12 is moved in a preset main scanning direction ("Y" direction). Further, in this embodiment, the ink jet head 12 performs printing on a medium 50 in a multi-pass method in which a plurality of main scanning operations is performed at each position of printing regions to be printed in a medium 50.

In FIG. 1(*a*), for convenience of illustration, only one ink jet head 12 is illustrated. However, the printing apparatus 10 may include a plurality of ink jet heads 12. For example, in a case that color printing is to be performed by using respective inks of "C", "M", "Y" and "K", the printing apparatus 10 may include a plurality of ink jet heads 12 which respectively eject ink droplets of respective inks of "C", "M", "Y" and "K".

The first ultraviolet light source 14 is an ultraviolet light source for irradiating ultraviolet rays to dots of ink which are formed by ink droplets landed on a medium 50. The first ultraviolet light source 14 irradiates ultraviolet rays, while moving in a main scanning direction together with the ink jet head 12 in a main scanning operation and thereby, immediately after dots of ink have been formed by ink droplets landed on the medium 50, ultraviolet rays are irradiated to the dots of ink. Further, in this embodiment, the first ultraviolet light source 14 is an example of a temporary curing ultraviolet light source and weak ultraviolet rays in such a degree that the ink is not completely cured are irradiated to the dots of ink to cure the dots of ink in a temporarily cured state. In this manner, the first ultraviolet light source 14 cures the dots of ink formed on the medium 50 in a temporarily cured state in each of the respective main scanning operations before the next main scanning operation is performed.

In this embodiment, "the temporarily cured state of a dot of ink" is a state that viscosity of ink is sufficiently increased by irradiation of ultraviolet rays and, more specifically, for example, a state that curing of a dot of ink is progressed to at least a gelatinous state with a viscosity at which blurring of the ink is not occurred even when the ink is contacted with other ink in a liquid state. Further, "the state that blurring is not occurred even when the ink is contacted with other ink in a liquid state" means that, for example, ink included in a dot in a temporarily cured state and other ink included in a dot in a liquid state are not mixed with each other even when they are contacted with each other. Further, it is preferable that a dot of ink in a temporarily cured state is, for example, cured to viscosity so as to be gradually spread with elapsed time during reaching to at least a certain diameter. According to this structure, for example, a dot gain of a dot of ink can be appropriately adjusted by adjusting time until curing has been completed after temporary curing.

Further, in this embodiment, the printing apparatus 10 includes a plurality of the first ultraviolet light sources 14. A plurality of the first ultraviolet light sources 14 is provided at each of positions interposing the ink jet head 12 in the main scanning direction. According to this structure, for example, in each of a forward path and a return path of the ink jet head 12 in a main scanning operation, ultraviolet rays are appropriately irradiated to dots of ink by the first ultraviolet light source 14 which is located at a backward side with respect to the ink jet head 12.

The scanning drive part 16 is a drive part for making the ink jet head 12 perform a main scanning operation and a sub scanning operation. The sub scanning operation is, for example, an operation for making the ink jet head 12 move relatively to a medium 50 in a sub scanning direction ("X" direction) which is perpendicular to the main scanning direction.

Further, in this embodiment, the scanning drive part 16 includes, for example, a carriage which holds the ink jet head 12 so as to face a medium 50, a guide rail for moving the carriage in the main scanning direction, and the like. The scanning drive part 16 makes the carriage move along the guide rail while making the ink jet head 12 eject ink droplets and thereby the ink jet head 12 performs the main scanning operation. Further, the scanning drive part 16 is moved in the sub scanning direction between the main scanning operations in a state holding the ink jet head 12 and thereby the ink jet head 12 performs the sub scanning operation. In addition, in this embodiment, the scanning drive part 16 moves the first ultraviolet light source 14 together with the ink jet head 12 in each of the main scanning operation and the sub scanning operation.

The second ultraviolet light source 18 is an example of a curing completion ultraviolet light source and ultraviolet rays are further irradiated to the dots of ink in a temporarily cured state to complete curing of the dots of ink. In this case, the second ultraviolet light source 18 irradiates, for example, a larger quantity of light (for example, at least one of an intensity of illumination and integrated quantity of light) of ultraviolet rays than the first ultraviolet light source 14 and thereby the integrated quantity of light of the ultraviolet rays which is received by the dots of ink is set to be larger than a predetermined quantity to complete the dots of ink. In this case, "curing of the dots of ink is completed" means that, for example, curing of the dots of ink has been reached to a state that the curing has progressed to at least an extent sufficient as a state that printing has completed.

Further, in this embodiment, the second ultraviolet light source 18 is, for example, arranged at a displaced position in the sub scanning direction with respect to the ink jet head 12 and the first ultraviolet light sources 14, and irradiates ultraviolet rays to respective positions of a medium 50, for example, after printing through all print passes has been completed. Alternatively, the second ultraviolet light source 18 may irradiate ultraviolet rays to a medium 50 after printing by the ink jet head 12 and irradiation of ultraviolet rays by the first ultraviolet light source 14 have been completed, for example, over the entire medium 50.

Further, in this embodiment, as shown in FIG. 1(*a*), the second ultraviolet light source 18 is an ultraviolet light source which is separately provided from the first ultraviolet light source 14. However, in a modified embodiment of a structure of the printing apparatus 10, for example, it is conceivable that an ultraviolet light source is used which is used both as the first ultraviolet light source 14 and the second ultraviolet light source 18. In this case, for example, one ultraviolet light source may be switched for use as the first ultraviolet light source 14 or the second ultraviolet light source 18 depending on a timing for irradiating ultraviolet rays.

The table part 20 is a table-shaped member whose upper face is flat and an entire medium 50 is placed on its upper face, and the table part 20 holds the medium 50 so as to face the ink jet head 12. It is preferable that an upper face of a medium 50 is formed of thermally conductive material such as metal. According to this structure, for example, temperature of each position of a medium 50 can be appropriately made uniform. Further, the printing apparatus 10 may further include a heat dissipation plate formed of metal or the like between the table part 20 and a medium 50.

The control section 22 is, for example, a CPU of the printing apparatus 10 which controls operations of respective parts of the printing apparatus 10. Further, in this embodiment, the control section 22 controls irradiation of ultraviolet rays by the first ultraviolet light source 14 in a main scanning operation based on ultraviolet irradiation settings stored in the irradiation setting storage section 24. The irradiation setting storage section 24 is, for example, a storage device such as a memory of the printing apparatus 10 and stores ultraviolet irradiation settings which represent irradiation settings of ultraviolet rays from the first ultraviolet light source 14 to a medium 50. The ultraviolet irradiation settings are, for example, a profile specifying operations of the first ultraviolet light source 14.

Further, in this embodiment, the irradiation setting storage section 24 stores a plurality of types of ultraviolet irradiation settings which are respectively associated with various print conditions. In this case, the print conditions include various conditions such as a type of medium 50, a printing speed, the number of print passes, and types of using inks. Further, the control section 22 controls an operation of the first ultraviolet light source 14 based on the ultraviolet irradiation setting corresponding to a print condition. As a result, the first ultraviolet light source 14 irradiates ultraviolet rays to dots of ink on a medium 50 in each of the main scanning operations based on the ultraviolet irradiation setting stored in the irradiation setting storage section 24.

Further, more specifically, in this embodiment, the irradiation setting storage section 24 stores, as the ultraviolet irradiation setting corresponding to a print condition, an ultraviolet irradiation setting which has been set so that, regarding temperature in a region where ink droplets are to be ejected by the ink jet head 12 in each of the main scanning operations in a multi-pass method, an increasing range of temperature compared with temperature at a timing performed in the last main scanning operation is zero. In this case, "an increasing range of temperature of a medium 50" means, for example, a temperature rising range of a medium 50 due to heat generated by the first ultraviolet light source 14 through irradiation of ultraviolet rays. Further, more specifically, a temperature rise of a medium 50 may include a temperature rise which is occurred by, for example, applying polymerization heat of a monomer of ink in addition to the heat generated by the first ultraviolet light source 14. Further, "regarding temperature of a medium 50, an increasing of temperature compared with temperature at a timing of the last main scanning operation is zero" means that temperature does not rise substantially. "Temperature does not rise substantially" means, for example, that a temperature rise is not occurred except a range capable of attaining a purpose that a difference between print passes is prevented from being occurred in a dot gain of ink. Therefore, for example, in addition to a case that temperature does not rise completely, a case may be included in which a temperature rise occurs to an extent that a difference of dot gains causes no problem. Further, "a difference of dot gains causes no problem" means, for example, a difference of dot gains causes no problem in accuracy which is determined depending on demanded printing quality.

Further, "an increasing range of temperature compared with temperature at a timing of the last main scanning operation is zero" means that, for example, in respective regions of a medium 50, temperature of a medium 50 at a timing for performing the next main scanning operation does not rise in comparison with the temperature at the timing having been performed in the last main scanning operation. Therefore, for example, tentatively, even if temperature of a medium 50 has been increased just after the last main scanning operation, this case may be included when the temperature of the medium 50 is decreased before the timing of the next main scanning operation.

Further, "an increasing range of temperature compared with temperature at a timing of the last main scanning operation is zero" may include, for example, that the temperature rise is not more than a predetermined reference value. In this case, the reference value of a temperature rise is, for example, set beforehand so that a difference of dot gains causes no problem. More specifically, for example, it is conceivable that a temperature rise occurred by one main scanning operation is set to be not more than, for example, 1° C. Further, it is further preferable that the temperature rise is set to be not more than, for example, 0.5° C. Further, it is further preferable that, instead of setting a temperature rise occurred by one main scanning operation, a reference value of a temperature rise is set depending on a temperature rise occurred by all main scanning operations for the number of print passes. In this case, it is conceivable that a temperature rise occurred by all main scanning operations is set to be not more than, for example, 2° C. Preferably, this temperature rise is not more than 1° C. and further preferably, not more than 0.5° C. The ultraviolet irradiation setting will be described in detail below.

FIG. 1(*b*) shows an example of a detailed structure of the first ultraviolet light source 14. In this embodiment, the first ultraviolet light source 14 includes a plurality of independent light source parts 102. The independent light source part 102 is an ultraviolet light source including one or a plurality of LED parts 202 and is structured so as to be capable of independently controlling turning on and off and its quantity of light. The LED part 202 is a UVLED for generating ultraviolet rays. The LED part 202 may be structured, for example, of a plurality of UVLEDs arranged in a row. Further, in this embodiment, the irradiation setting storage section 24 stores ultraviolet irradiation settings at least representing, for example, which the independent light source part is turned on for the first ultraviolet light source 14 having such a structure.

According to this embodiment, the independent light source parts 102 which are ultraviolet light sources divided into blocks can be individually turned on and off and thus, for example, a way of irradiation of ultraviolet rays can be appropriately adjusted according to various ultraviolet irradiation settings. Further, as a result, for example, a temperature rise of a medium 50 can be suppressed further appropriately.

Further, in this case, heat generated by the first ultraviolet light source 14 can be appropriately reduced, for example, by using a UVLED whose heating value is small in comparison with an ultraviolet lamp, a metal halide lamp and the like. Further, as a result, for example, a temperature rise of a medium 50 can be further appropriately suppressed. Further, normally, switching of turning on and off of a UVLED is easily performed in comparison with an ultraviolet lamp, a metal halide lamp and the like. Therefore, according to this embodiment, for example, switching of turning on and off of each of the independent light source parts 102 can be further appropriately performed.

Next, the ultraviolet irradiation settings used in this embodiment will be described in detail below. First, for convenience of explanation, various experiments having been executed by the present inventors for attaining the structure of the printing apparatus 10 in this embodiment will be described below.

As described above, the present inventors have executed earnest research on a structure for printing in a multi-pass method by using ultraviolet curing type inks. As a result, the present inventors have found that, for example, a difference between print passes is occurred in dot spreading (dot gain) of ink formed on a medium and unevenness or the like occurs between print passes. Further, in order to investigate the cause, for example, the present inventors have executed experiments for measuring surface temperature of a medium at the time of printing by using a far infrared camera.

Figures 2A, 2B:
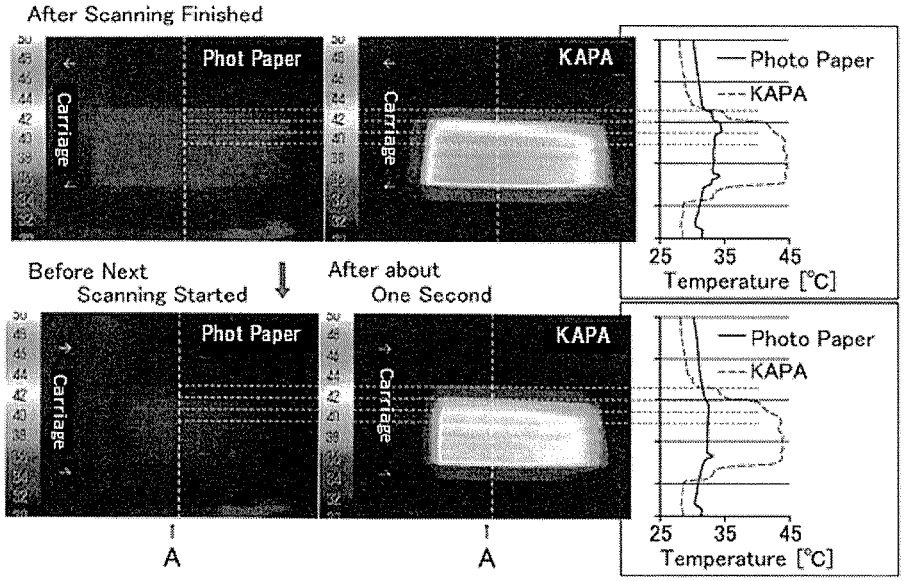
FIGS. 2(*a*) and 2(*b*) are views for explaining experiments regarding a difference of surface temperatures depending on types of a medium.

FIGS. 2(*a*) and 2(*b*) and FIGS. 3(*a*), 3(*b*) and 3(*c*) are views which explain experiments for measuring surface temperature of a medium at the time of printing. FIGS. 2(*a*) and 2(*b*) are views for explaining experiments regarding a difference of surface temperatures depending on types of a medium. In this experiment, based on the finding of the present inventors that, even in a case using the same ink in the same printing apparatus (ink jet printer), a difference is occurred in image quality according to a type of a medium, surface temperatures of media during printing are respectively measured for plural types of media in which a difference in printing image quality is occurred.

Experiment conditions are shown in FIG. 2(*a*). This experiment has been, as shown in FIG. 2(*a*), executed by using a JFX500 type ink jet printer which is a publicly known printing apparatus. As ink, an ink of LUS-150/made by MIMAKI ENGINEERING CO., LTD. which is a publicly known ink was used. Further, an ARTCAM-320-THERMO type camera was used as a far infrared camera for measuring temperature.

Further, as plural types of media, a publicly known photo paper and a "KAPA" board were used. The "KAPA" board is a plate-shaped medium made by "KAPA" company. Further, a "KAPA" board is a medium whose heat insulation property is high in comparison with a photo paper.

In a flat bed type printing apparatus, a medium is not required to be conveyed, for example, at the time of printing and thus, for example, a medium whose thickness is large may be used. Further, for example, a board-shaped medium whose heat insulation property is large may be used. In these cases, for example, a heat storage property of the medium becomes large and influence of heat generated by the ultraviolet light source may be easily subjected. A "KAPA" board is an example of such a medium. Further, for convenience of the experiment, in this experiment, instead of a method in which dots of ink are temporarily cured, dots of ink were cured by a normal method in which curing of ink has been completed during a main scanning operation.

FIG. 2(*b*) is a view showing results of the experiments, which are results of temperature measurements immediately after the completion of the first main scanning operation (after completion of scanning) and before starting the next main scanning operation (before starting the next scanning) when printing is performed in a multi-pass method. A timing before starting the next main scanning operation is the timing that about one second has passed after the first main scanning operation has completed. Further, in FIG. 2(*b*), the photographs on a left side portion show photographed results for a photo paper (left side) and a KAPA board (right side) by a far infrared camera. The graphs on a right side portion in FIG. 2(*b*) show temperature at each position along the line shown by the reference sign "A" in the photograph portion.

As shown in FIG. 2(*b*), in a photo paper, the surface temperature of the medium rises about 2° C. after the first main scanning operation. However, the temperature is lowered and becomes approximately constant before the next main scanning operation is started.

On the other hand, in a case of a "KAPA" board, the surface temperature of the medium rises about 5° C. after the first time main scanning operation. Further, the temperature is not lowered before the next main scanning operation is to be started. Therefore, in this case, the temperature is gradually increased as printing is proceeded. For example, at the time when the main scanning operations for all print passes have completed, the temperature of the region where the main scanning operations have been performed on the "KAPA" board has risen to about 45° C.

Further, regarding the quality of the printed result, unevenness which causes a problem did not occur between print passes in the photo paper. Further, as a result of further detailed observation, regarding dot spreading (dot gain) of ink formed on the medium, a significant difference did not occur between the print passes. On the other hand, unevenness has occurred between the print passes in the "KAPA" board and the print quality is lowered in comparison with the print result of the photo paper. Further, a difference of the dot gain has occurred between the print passes.

As described above, in the "KAPA" board, the temperature rises gradually as printing is proceeded. Therefore, regarding a difference of a dot gain occurred between print passes and unevenness between print passes resulted from the difference, the present inventors considered that these are related to a gradual rise of temperature of a medium. Therefore, the present inventors have executed further experiments regarding temperature change of a medium occurred during printing.

FIGS. 3(*a*), 3(*b*) and 3(*c*) are views for explaining experiments in which distribution of surface temperature of a medium during printing is measured. FIG. 3(*a*) shows experiment conditions. Experiment conditions in this experiment are the same or similar to the experiment conditions of the experiment described in FIGS. 2(*a*) and 2(*b*) except the points shown in FIG. 3(*a*) and the points described below. For example, the printing apparatus, an infrared camera and the like which are used are the same as the experiment described with reference to FIGS. 2(*a*) and 2(*b*). Further, in this experiment, printing is performed on a "KAPA" board in a multi-pass method whose number of passes is "8".

FIG. 3(*b*) shows results of the experiment which are results of temperature measurement for regions where respective main scanning operations are performed in a case that printing is performed in a multi-pass method. FIG. 3(*c*) is an enlarged view showing a part in FIG. 3(*b*).

In FIG. 3(*b*), the photograph on a left side portion shows a photographed result by a far infrared camera. In the photograph, the portions indicated as the "first pass (1st Pass)" through the "seventh pass (7th Pass)" represent regions where the first through the seventh main scanning operations have been performed in a multi-pass method. Further, the portion indicated as "Completed" represents a region where the eighth main scanning operation has been completed. The graph on a right side portion in FIG. 3(*b*) show temperatures at respective positions along a line extended in a longitudinal direction at a center part of the photograph.

As shown in FIG. 3(*b*), the temperature in the respective regions of a medium rises gradually from the start of the main scanning operation corresponding to the first print pass to the completion of all print passes. More specifically, for example, as shown in FIG. 3(*c*), temperatures of the respective regions of a medium rise about 2° C.-4° C. each time the main scanning operation corresponding to each print pass has been performed. Further, as a result, a 10° C. or more temperature difference is generated between the region corresponding to the first print pass (first pass region) and the region corresponding to the last eighth print pass (completed region). After completion of the print passes, the completed region keeps approximately constant temperature for a while. Further, after irradiation of ultraviolet rays has been completed, the temperature is gradually lowered.

As described above, in a case that printing is performed in a multi-pass method, a temperature difference may occur depending on a type of medium between regions where the main scanning operations are performed in respective print passes. For example, in a case of a structure in the experiment described with reference to FIGS. 3(*a*), 3(*b*) and 3(*c*), regarding temperatures in the regions where the main scanning operations of the respective print passes have been performed, a temperature difference of about 2° C.-4° C. has occurred between the print passes. Further, as a result, it is considered that a difference of the dot gain has occurred between the print passes and unevenness has occurred between the print passes.

In this embodiment, in the printing apparatus 10 described with reference to FIG. 1(*a*) and the like, different from the experiment conditions described with reference to FIGS. 2(*a*) and 2(*b*) and FIGS. 3(*a*), 3(*b*) and 3(*c*), the dot of ink is cured in two steps by setting the dot of ink in a temporarily cured state. However, when printing is performed in a multi-pass method, even in a case that the dot of ink is cured in two steps, a problem of a temperature rise as described above may be similarly occurred. Therefore, when the ultraviolet irradiation settings stored in the irradiation setting storage section 24 (see FIG. 1(*a*)) are to be prepared, it is preferable that ultraviolet irradiation settings are prepared so as not to occur the temperature rise for each of various specific print conditions.

Figure 4:
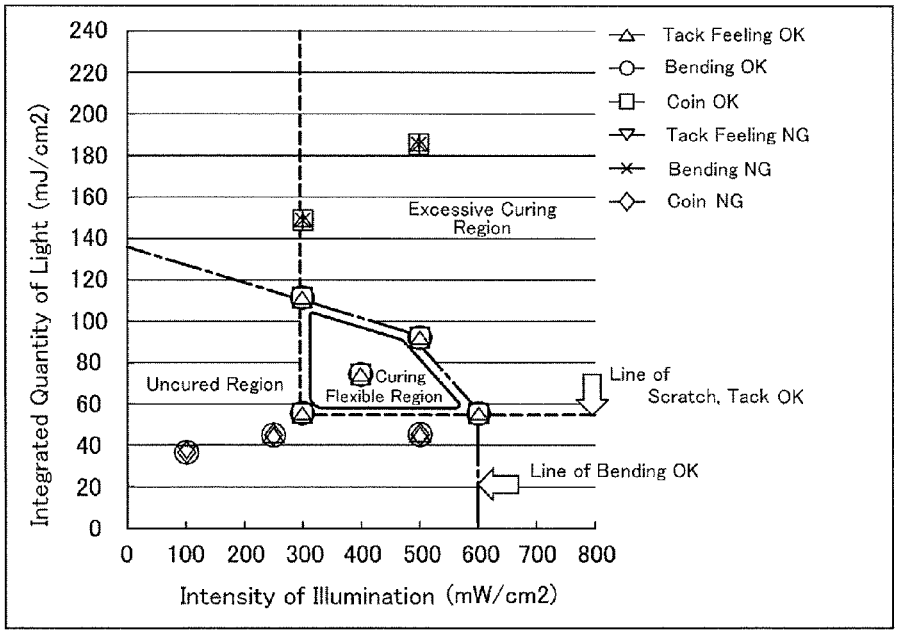
FIG. 4 is a graph showing results of experiments regarding curability of an ultraviolet curing type ink.

Next, experiments executed for curability of an ultraviolet curing type ink will be described below. FIG. 4 is a graph showing results of experiments regarding curability of an ultraviolet curing type ink. In this experiment, an ink of LUS-150/made by MIMAKI ENGINEERING CO., LTD. which is a publicly known ink was used, and an intensity of illumination and the integrated quantity of light of irradiated ultraviolet rays are variously changed and cured inks under the respective conditions have been evaluated.

In this experiment, similarly to the experiments described with reference to FIGS. 2(*a*) and 2(*b*) and FIGS. 3(*a*), 3(*b*) and 3(*c*), the JFX500 type ink jet printer was used as a printing apparatus. Further, the resolution of printing is 600×600 dpi and printing was performed in a multi-pass method whose pass number is "4". Further, ejection of an ink droplet was set to be a normal binary size (Bi/Normal) and the dot of ink was cured by a normal method in which curing of ink has been completed during the main scanning operation.

As evaluations, a tack feeling evaluation, a bending property evaluation and a scratch evaluation were performed. The tack feeling evaluation is, for example, an evaluation for confirming whether the adhesiveness of cured ink is within a predetermined criterion or not. The bending property evaluation is, for example, an evaluation for confirming whether a medium is provided with flexibility so as to be capable of being bent or not. The scratch evaluation is, for example, an evaluation for confirming whether a printed region is provided with a sufficient peeling resistant property or not by rubbing the printed region by using a coin or the like.

As shown in the graph, in order to cure the dot of ink so that the results of the tack feeling evaluation and the scratch evaluation are acceptable (OK), the integrated quantity of light of ultraviolet irradiation is required to increase to some extent. More specifically, for example, in the graph, the integrated quantity of light is required to be larger than the line (broken line) represented as the "Line of Scratch, Tack OK". On the other hand, in a case that the integrated quantity of light is excessively increased, its flexibility becomes insufficient and the evaluation result of flexibility becomes rejection (NG). More specifically, for example, in the graph, the integrated quantity of light is required to be smaller than the line (alternate long and short dash line) represented as the "Line of Bending OK". Further, in a state of the excessive curing that the integrated quantity of light becomes too large, the adhesion property of the dot of ink may be lowered. In addition, in the cases of excessively small intensity of illumination of ultraviolet rays and excessively large intensity of illumination of ultraviolet rays, a region in an appropriate curing state between an uncured state and an excessive cured state becomes small and, as a result, it is difficult to cure the dot of ink in an appropriate state.

Therefore, in order to satisfy predetermined criteria for various evaluations and to secure a required margin, like a region (curing flexible region) shown in the center portion of the graph as a region where the extent of curing and flexibility are appropriate, it is required that ultraviolet rays are irradiated so that the intensity of illumination is within a fixed range and the integrated quantity of light is within a predetermined range.

In this embodiment, in the printing apparatus 10 described with reference to FIG. 1(*a*) and the like, the dot of ink is cured in two steps by setting the dot of ink into a temporarily cured state. Therefore, preferred specific ranges of the intensity of illumination and the integrated quantity of light of ultraviolet irradiation may be partly different from the case shown in FIG. 4. However, it is considered that, even when dot of ink is cured in two steps, a qualitative relationship between the intensity of illumination and the integrated quantity of light and evaluation results is similar to the case shown in FIG. 4. Therefore, when ultraviolet irradiation settings stored in the irradiation setting storage section 24 (see FIG. 1(*a*)) are to be prepared, it is preferable to prepare the ultraviolet irradiation settings by confirming a preferred intensity of illumination and a preferred integrated quantity of light by experiments for each of various specific print conditions. Further, when the ultraviolet irradiation settings are to be prepared, in addition to the above-mentioned evaluation items, it is preferable to prepare the ultraviolet irradiation settings further based on various other evaluation results such as adhesion property to a medium.

Next, the ultraviolet irradiation setting used in this embodiment will be described further in detail below. FIG. 5 is a view showing an example of a structure of ultraviolet irradiation settings.

As described with reference to FIG. 1(*a*), in this embodiment, a dot of ink is cured in two steps in the printing apparatus 10 (see FIG. 1(*a*)). In this case, it is sufficient that the dot of ink is cured in a temporarily cured state at the time of the main scanning operation. Therefore, according to this embodiment, for example, a light quantity of ultraviolet rays which is irradiated in each of the main scanning operations can be reduced.

However, also in this case, regarding settings of the intensity of illumination and an integrated quantity of light of ultraviolet rays for temporarily curing a dot of ink, when settings are performed, for example, only in consideration of preventing blurring of a dot of ink and the condition for appropriately flattening a dot of ink in a temporarily cured state (condition for setting a printed result to gloss), temperature of a medium is rendered in an easily rising state according to print conditions and a problem of unevenness between print passes may be occurred.

However, in this embodiment, as described with reference to FIG. 1(*a*), an ultraviolet irradiation setting is used which is set so that a temperature rise of a medium is not occurred due to irradiation of ultraviolet rays which are irradiated in each of the main scanning operations for temporarily curing a dot of ink. Therefore, according to this embodiment, a temperature rise of a medium can be further suppressed appropriately.

Further, in this embodiment, the irradiation setting storage section 24 (see FIG. 1(*a*)) stores ultraviolet irradiation settings which are prepared for each of various print conditions as the ultraviolet irradiation settings. The print conditions are, for example, a type of a medium, a print speed, the number of print passes, a type of ink to be used and the like. The irradiation setting storage section 24 stores, for example, ultraviolet irradiation settings for various print conditions determined for these elements (factors) such that, in a case under a condition that temperature of a medium is further easily increased, a light quantity of ultraviolet rays is further reduced.

More specifically, regarding various print conditions, in this embodiment, the printing apparatus 10 is capable of using plural types of ink as ink which is used for printing. Further, the printing apparatus 10 is capable of printing on plural types of a medium and, in addition, as a print speed for printing and the pass number of printing in a multi-pass method, the printing apparatus 10 is capable of setting plural kinds of a print speed, plural kinds of print resolution and plural kinds of pass number which are respectively different from each other.

Further, the irradiation setting storage section 24 stores, for example, ultraviolet irradiation settings associated with the type of ink which is used in the printing apparatus 10 so as to correspond to the structure of the printing apparatus 10. For example, as shown in FIG. 5, the irradiation setting storage section 24 stores ultraviolet irradiation settings (A1, A2, . . . D5, D6, . . . ) further associated with other print conditions for each of types "X" and "Y" of ink to be used. As a result, the first ultraviolet light source 14 (see FIG. 1(*a*)) irradiates ultraviolet rays to dots of ink based on the ultraviolet irradiation setting which is stored in the irradiation setting storage section 24 associated with the type of ink to be used, for example, depending on control of the control section 22 (see FIG. 1(*a*)).

Further, the irradiation setting storage section 24 stores, for example, respectively different ultraviolet irradiation settings for plural types of a medium so as to be associated with the type of each medium. For example, as shown in FIG. 5, the irradiation setting storage section 24 stores ultraviolet irradiation settings which are further associated with other print conditions for each of types "M1" and "M2" of a medium in each of types "X" and "Y" of ink used. Therefore, in a case that printing is to be performed on either of plural types of a medium, the first ultraviolet light source 14 irradiates ultraviolet rays to dots of ink based on the ultraviolet irradiation setting which is stored in the irradiation setting storage section 24 associated with the type of the medium, for example, depending on control of the control section 22.

As the ultraviolet irradiation setting depending on a type of a medium, for example, in a case that a medium whose heat storage property is further large is to be used, it is conceivable that a light quantity of ultraviolet rays is set to be further reduced. A medium whose heat storage property is large is, for example, a medium whose heat insulation property on its surface is high. Further, in this case, the irradiation setting storage section 24 stores, for example, respectively different ultraviolet irradiation settings associated with the type of the medium for plural types of a medium whose heat storage property is different.

Further, the irradiation setting storage section 24 stores, for example, respectively different ultraviolet irradiation settings associated with the type of the medium for plural kinds of a print speed, resolution and pass number of printing. For example, as shown in FIG. 5, the irradiation setting storage section 24 stores the ultraviolet irradiation settings (A1, A2, . . . D5, D6, . . . ) associated with respective conditions of plural kinds of a print speed (high speed and low speed), resolution (D1 and D2) and pass number of printing (P1 through P6) in each of types "X" and "Y" of ink and in each of types "M1" and "M2" of a medium.

In FIG. 5, for simplification of description, examples are shown in which resolution is determined depending on a print speed. Specifically, when a print speed is high, the resolution is set in "D1". Further, when a print speed is low, the resolution is set in "D2". In this manner, the ultraviolet irradiation setting is also associated with resolution together with a print speed. As another example of a structure of the ultraviolet irradiation settings, the ultraviolet irradiation settings may be associated with resolution independently from a print speed.

Further, regarding setting of a pass number, there may be a case that the pass number capable of setting is different according to a print speed. Therefore, in FIG. 5, the pass number which is capable of setting when a print speed is high is specified as "P1", "P2" and "P3", and the pass number which is capable of setting when a print speed is low is specified as "P4", "P5" and "P6". One or all of "P1", "P2" and "P3" may be the same as one or all of "P4", "P5" and "P6".

Further, in this embodiment, regarding plural kinds of a print speed, the irradiation setting storage section 24 stores, for example, ultraviolet irradiation settings such that a light quantity of ultraviolet rays corresponding to a faster print speed is further reduced. Further, regarding plural kinds of a pass number, ultraviolet irradiation settings are stored such that a light quantity of ultraviolet rays corresponding to a larger pass number is further reduced. According to these structures, for example, a temperature rise of a medium can be further suppressed appropriately.

Further, as also described with reference to FIG. 1(*a*), the ultraviolet irradiation settings associated with various printing conditions are settings (profile) representing ways of irradiating ultraviolet rays by the first ultraviolet light source 14. Each of the respective ultraviolet irradiation settings specifies, for example, an intensity of illumination of ultraviolet irradiation from the first ultraviolet light source 14 by specifying the independent light source part 102 to be turned on in the first ultraviolet light source 14 (see FIG. 1(*b*)). It is preferable that the ultraviolet irradiation setting specifies an operation of the first ultraviolet light source 14 so as to irradiate minimum necessary ultraviolet rays for curing in a temporarily cured state depending on each of the respective print conditions. Further, the ultraviolet irradiation setting may, for example, specify an integrated quantity of light of ultraviolet rays irradiated to a dot of ink by specifying a pulse width or the like of a pulse signal for turning on a UVLED in the first ultraviolet light source 14. Further, in order to specify an integrated quantity of light for completely curing a dot of ink, an irradiating way of ultraviolet rays by the second ultraviolet light source 18 (see FIG. 1(*a*)) may be further specified. Further, the ultraviolet irradiation setting may be, for example, associated with various conditions other than the printing conditions shown in FIG. 5.

Further, regarding the ultraviolet irradiation settings "A1" through "D6" shown in FIG. 5, all settings are not always required to be different from each other and the same ultraviolet irradiation setting may be used, for example, depending on different printing conditions. For example, regarding the conditions for plural kinds of a printing pass number, when the printing pass number is not more than a predetermined number, the same ultraviolet irradiation setting may be used. Further, for example, in a case that many kinds of a print speed are capable of setting, when the print speed is not more than a predetermined speed, the same ultraviolet irradiation setting may be used.

When the ultraviolet irradiation settings described above are used, for example, an appropriate ultraviolet irradiation setting is used depending on a type of ink and a type of a medium to be used. Further, even for setting a print speed and a print pass number, an appropriate ultraviolet irradiation setting can be used depending on each of the settings. Further, as a result, for example, a temperature rise in a medium can be suppressed further appropriately. Therefore, according to this embodiment, for example, in a case that an ultraviolet curing type ink is used and printing is performed in a multi-pass method, a difference of a dot gain of ink is appropriately prevented from occurring between printing passes. Further, as a result, unevenness and the like occurring between printing passes are suppressed and printing with high quality can be performed appropriately.

Next, another example of a structure of the printing apparatus 10 will be described below. As described with reference to FIG. 1(*a*), in a modified example of a structure of the printing apparatus 10, for example, an ultraviolet light source serving as both of the first ultraviolet light source 14 and the second ultraviolet light source 18 may be used. Further, the printing apparatus 10 may include a plurality of ink jet heads 12. Therefore, an example of a structure (second embodiment) in a case that an ultraviolet light source serving as both of the first ultraviolet light source 14 and the second ultraviolet light source 18 is used and the printing apparatus 10 includes a plurality of ink jet heads 12 will be described below.

Figure 6A:
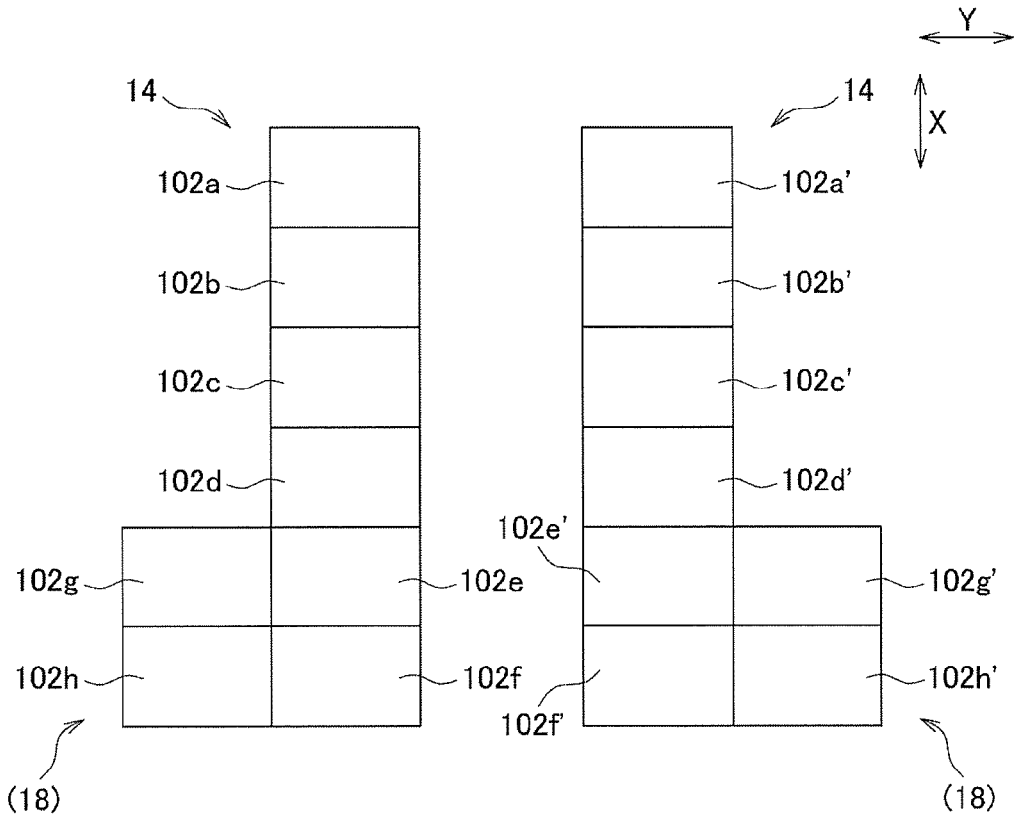
FIGS. 6(*a*) and 6(*b*) are views showing an example of a structure of the first ultraviolet light source 14 in a second example of a structure of the printing apparatus 10.
Figure 6B:
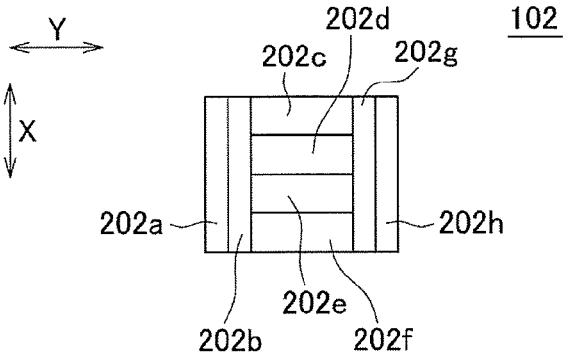
Figure 8:
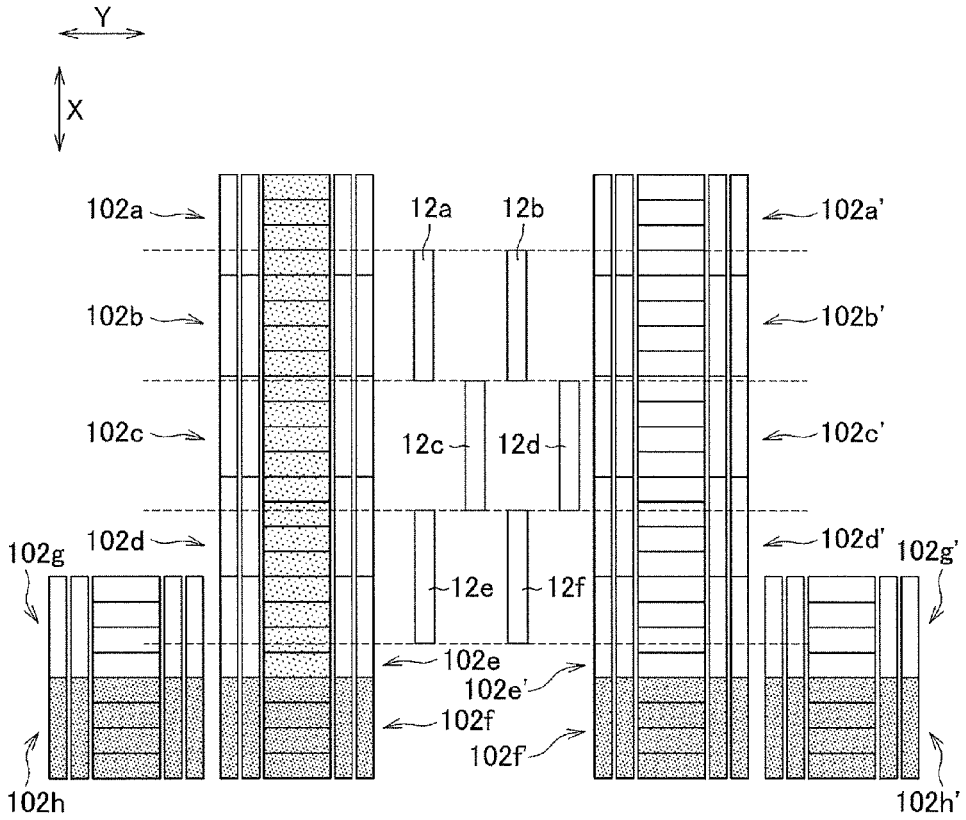
FIG. 8 is a view showing an example of an operation of the first ultraviolet light source 14 in a return path of a main scanning operation.

FIG. 6(*a*) through FIG. 8 show structures of ink jet heads and a first ultraviolet light source in accordance with a second embodiment of a structure of the printing apparatus 10. The second embodiment of a structure of the printing apparatus 10 is the same or similar to the printing apparatus 10 which is described with reference to FIGS. 1(*a*) through 5 except structures described below. For example, a structure of the second embodiment regarding portions except the ink jet heads and the first ultraviolet light source may be the same or similar to the printing apparatus 10 described with reference to FIGS. 1(*a*) through 5.

FIGS. 6(*a*) and 6(*b*) are views showing an example of a structure of the first ultraviolet light source 14. FIG. 6(*a*) shows an example of a structure of the first ultraviolet light source 14. FIG. 6(*b*) shows an example of a structure of an independent light source part 102 in the first ultraviolet light source 14.

In the second embodiment, the printing apparatus 10 includes, similarly to the structure shown in FIG. 1(*a*), the first ultraviolet light source 14 on one side and the other side with respect to the ink jet head in a main scanning direction. Further, each of the first ultraviolet light sources 14 includes a plurality of independent light source parts 102.

For example, as shown in FIG. 6(*a*), the first ultraviolet light source 14 disposed on one side with respect to the ink jet head includes eight independent light source parts 102*a* through 102*h*. Six independent light source parts 102*a* through 102*f* are arranged on the near side to the ink jet head in a sub scanning direction ("X" direction). Further, two independent light source parts 102*g* and 102*h* are arranged on a far side with respect to the ink jet head in the sub scanning direction so as to be adjacent to the independent light source parts 102*e* and 102*f* in the main scanning direction ("Y" direction). Further, the first ultraviolet light source 14 disposed on the other side with respect to the ink jet head includes eight independent light source parts 102*a*' through 102*h*'. Six independent light source parts 102*a*' through 102*f*' are arranged on the near side with respect to the ink jet head in the sub scanning direction. Further, two independent light source parts 102*g*' and 102*h*' are arranged on a far side with respect to the ink jet head in the sub scanning direction so as to be adjacent to the independent light source parts 102*e*' and 102*f*' in the main scanning direction.

Further, as also described above, the second embodiment is an example in a case that an ultraviolet light source serving as both of the first ultraviolet light source 14 and the second ultraviolet light source 18 is used. Therefore, in the second embodiment of the printing apparatus 10, the second ultraviolet light source 18 provided separately from the first ultraviolet light source 14 as shown in FIG. 1(*a*) is not used. And, the independent light source parts 102*f*, 102*h*, 102*f*' and 102*h*' as a part of the first ultraviolet light source 14 function as the second ultraviolet light source 18.

Further, in the second embodiment, each of the independent light source parts 102 (each of the independent light source parts 102*a* through 102*h* and 102*a*' through 102*h*') is, as shown in FIG. 6(*b*), provided with a plurality of LED parts 202*a* through 202*h*. Each of a plurality of the LED parts 202*a* through 202*h* is a portion having a plurality of UVLEDs mounted on a circuit board. For example, each of the LED parts 202*a*, 202*b*, 202*g* and 202*h* among a plurality of the LED parts 202*a* through 202*h* is provided with eight UVLEDs arranged in the sub scanning direction. Further, each of the LED parts 202*c* through 202*f* is provided with two rows of four UVLEDs arranged in the main scanning direction. Further, these UVLEDs formed in two rows are arranged in the sub scanning direction.

Further, in the second embodiment, each of a plurality of the LED parts 202*a* through 202*h* in one of the independent light source parts 102 is capable of independently controlling turning on and off. Therefore, for example, a light quantity of the independent light source part 102 can be changed appropriately by selecting which of a plurality of the LED parts 202*a* through 202*h* is turned on.

Figure 7:
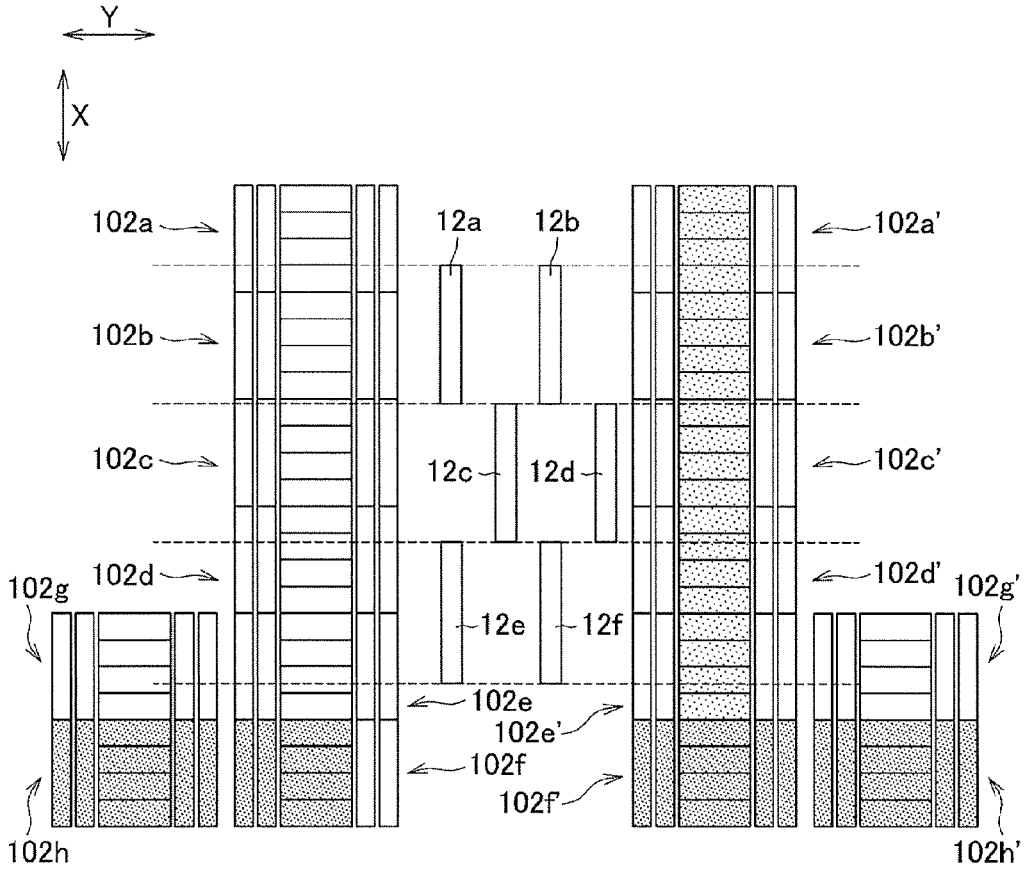
FIG. 7 is a view showing an example of an operation of the first ultraviolet light source 14 in a forward path of a main scanning operation.

Next, an example of an operation of the first ultraviolet light source 14 at the time of a main scanning operation will be described below. FIG. 7 is a view showing an example of an operation of the first ultraviolet light source 14 in a forward path of a main scanning operation. FIG. 8 is a view showing an example of an operation of the first ultraviolet light source 14 in a return path of a main scanning operation.

As described above, in the second embodiment, the printing apparatus 10 include a plurality of ink jet heads. Therefore, in FIGS. 7 and 8, an arrangement of a plurality of the ink jet heads 12*a* through 12*f* and a positional relationship between the ink jet heads 12*a* through 12*f* and the first ultraviolet light source 14 are also shown.

For example, in the second embodiment, the printing apparatus 10 includes a plurality of ink jet heads 12*a* through 12*f* for ejecting droplets of inks whose colors are respectively different from each other at a position interposed between a plurality of the first ultraviolet light sources 14. In this case, for example, the ink jet heads 12*a* through 12*d* are ink jet heads for respective color inks of "C", "M", "Y" and "K" inks. Further, the ink jet heads 12*e* and 12*f* are ink jet heads for inks of color other than "C", "M", "Y" and "K" (for example, white or various special colors or the like).

Further, the independent light source parts 102*a* through 102*e*, 102*g*, 102*a*' through 102*e*' and 102*g*' in a plurality of the first ultraviolet light sources 14 are provided at positions interposing the ink jet heads 12*a* through 12*f* in the main scanning direction. Therefore, the independent light source parts 102*a* through 102*e*, 102*g*, 102*a*' through 102*e*' and 102*g*' irradiate ultraviolet rays for temporarily curing dots of ink to the dots at the time of a main scanning operation. Further, the independent light source parts 102*f*, 102*h*, 102*f*' and 102*h*' are provided at positions on a rear side relative to the ink jet heads 12*a* through 12*f* in a moving direction of the ink jet heads 12*a* through 12*f* at the time of a sub scanning operation. Therefore, the independent light source parts 102*f*, 102*h*, 102*f*' and 102*h*' irradiate ultraviolet rays to a region on a medium where the main scanning operation has been finished to complete curing of the dots of ink.

More specifically, in a forward path of a main scanning operation, for example, as shown in FIG. 7, the control section of the printing apparatus 10 turns on the independent light source parts 102*a*' through 102*f*' and 102*h*' of the first ultraviolet light source 14 (the first ultraviolet light source 14 shown on a right side in FIG. 7) which are arranged on the rear side relative to the ink jet heads 12*a* through 12*f* and the independent light source parts 102*f* and 102*h* of the first ultraviolet light source 14 arranged on the front side (left side) based on the ultraviolet irradiation settings. Further, the remaining independent light source parts 102 are set to be turned off. In this case, the rear side and the front side relative to the ink jet heads 12*a* through 12*f* are a rear side and a front side in a moving direction of the ink jet heads 12*a* through 12*f* at the time of a main scanning operation.

Further, the LED parts 202 (respective LED parts 202*a* through 202*h* in FIG. 6(*b*)) which are to be turned on in the respective independent light source parts 102 are selected to adjust the intensity of illumination of each of the independent light source parts 102. For example, the intensities of illumination of the independent light source parts 102*a*' through 102*e*' are set to about 400 mW/cm$^2$ by turning on the LED parts 202 expressed in half-tone dots in the drawing. Further, the intensities of illumination of the independent light source parts 102*f*, 102*h*, 102*f*' and 102*h*' are set to about 500 mW/cm$^2$.

Further, in a return path of the main scanning operation, for example, as shown in FIG. 8, the control section of the printing apparatus 10 turns on the independent light source parts 102*a* through 102*f* and 102*h* of the first ultraviolet light source 14 (the first ultraviolet light source 14 shown on a left side in FIG. 8) which are arranged on the rear side relative to the ink jet heads 12*a* through 12*f* and the independent light source parts 102*f*' and 102*h*' of the first ultraviolet light source 14 arranged on the front side (right side) based on the ultraviolet irradiation settings. Further, the remaining independent light source parts 102 are set to be turned off.

Further, also in this case, the LED parts 202 which are to be turned on in the respective independent light source parts 102 are selected to adjust the intensity of illumination of each of the independent light source parts 102. For example, the intensities of illumination of the independent light source parts 102*a* through 102*e* are set to about 400 mW/cm$^2$ by turning on the LED parts 202 expressed in half-tone dots in the drawing. Further, the intensities of illumination of the independent light source parts 102*f*, 102*h*, 102*f*' and 102*h*' are set to about 500 mW/cm$^2$.

According to this structure, for example, even in a case that a medium such as a "KAPA" board which is hard to radiate heat is used, dots of ink can be temporarily cured appropriately in each of a forward path and a return path of the main scanning operation while restraining influence of heat generated by the first ultraviolet light source 14. Further, after having been temporarily cured, curing can be completed appropriately. Therefore, also in the second embodiment, for example, in a case that an ultraviolet curing type ink is used and printing is performed in a multi-pass method, a difference of a dot gain of ink is appropriately prevented from occurring between printing passes. Further, as a result, unevenness and the like occurring between printing passes are suppressed and printing with high quality can be performed appropriately.

The present invention has been described with reference to the embodiments but the technical scope of the present invention is not limited to the embodiments described above. It is clear for a person in the art that various changes and modifications can be applied to the embodiments. Such embodiments obtained by appropriately combining changes and modifications are also included in a technical scope of the present invention.

INDUSTRIAL APPLICABILITY

The present invention may be preferably utilized, for example, in a printing apparatus.

What is claimed is:

1. A printing apparatus for printing in an ink jet method, comprising:

an ink jet head for ejecting ink droplets of an ultraviolet curing type ink, which is cured by ultraviolet rays, toward a medium;

a temporary curing ultraviolet light source which is an ultraviolet light source for irradiating ultraviolet rays to dots of ink formed of the ink droplets landed to the medium, the temporary curing ultraviolet light source generating ultraviolet rays for curing the dots of the ink in a temporarily cured state;

an irradiation setting storage section which stores ultraviolet irradiation settings indicating irradiation settings of ultraviolet rays from the temporary curing ultraviolet light source to the medium; and a curing completion ultraviolet light source for further irradiating ultraviolet rays to the dots of the ink in the temporarily cured state to complete curing of the dots of the ink;

wherein the ink jet head ejects ink droplets to the medium by performing a main scanning operation for ejecting ink droplets while moving in a preset main scanning direction, and performs a printing to the medium by a multi-pass method in which a plurality of the main scanning operations is performed for respective positions of a printing region to be printed on the medium;

wherein the temporary curing ultraviolet light source irradiates ultraviolet rays to dots of the ink on the medium in each of the plurality of the main scanning operations based on the ultraviolet irradiation settings stored in the irradiation setting storage section; and wherein the irradiation setting storage section stores the ultraviolet irradiation settings which are set so that, regarding temperature of the region where the ink jet head ejects ink droplets in each of the plurality of the main scanning operations in the multi-pass method, an increasing range of temperature compared with temperature at a timing of the last main scanning operation is suppressed within a temperature rising range which dot gains of the dots of the ink are substantially the same as each other.

2. The printing apparatus according to claim 1, wherein the temporary curing ultraviolet light source cures the dots of the ink in the temporarily cured state, which is a state where curing of a dot of ink is progressed to at least a gelatinous state with viscosity at which blurring of the ink is not occurred even when the ink is contacted with other ink.

3. The printing apparatus according to claim 1, wherein the irradiation setting storage section stores the ultraviolet irradiation settings for plural types of the medium which are different from each other so as to be associated with the type of each medium, and in a case that printing is to be performed on either of the plural types of a medium, the temporary curing ultraviolet light source irradiates ultraviolet rays to dots of the ink based on the ultraviolet irradiation setting stored in the irradiation setting storage section so as to be associated with the type of the medium.

4. The printing apparatus according to claim 1, wherein the printing apparatus is capable of setting plural kinds of a print speed different from each other as a print speed for printing, the irradiation setting storage section stores ultraviolet irradiation settings for the plural kinds of the print speed different from each other so as to be associated with the respective print speeds, and the temporary curing ultraviolet light source irradiates ultraviolet rays to the dots of the ink based on the ultraviolet irradiation setting which is stored in the irradiation setting storage section so as to be associated with the print speed for printing.

5. The printing apparatus according to claim 1, wherein the printing apparatus is capable of setting plural kinds of a pass number as a pass number of printing in the multi-pass method, the irradiation setting storage section stores the ultraviolet irradiation settings for the plural kinds of the pass number different from each other so as to be associated with the respective pass numbers, and the temporary curing ultraviolet light source irradiates ultraviolet rays to the dots of the ink based on the ultraviolet irradiation setting which is stored in the irradiation setting storage section so as to be associated with the pass number for printing.

6. The printing apparatus according to claim 1, wherein the irradiation setting storage section stores the ultraviolet irradiation settings associated with types of the ink to be used in the printing apparatus, and the temporary curing ultraviolet light source irradiates ultraviolet rays to the dots of the ink based on the ultraviolet irradiation setting which is stored in the irradiation setting storage section so as to be associated with the type of the ink to be used.

7. The printing apparatus according to claim 1, wherein the temporary curing ultraviolet light source comprises a plurality of independent light source parts each of which is independently capable of controlling turning on and off and its light quantity, and the irradiation setting storage section stores the ultraviolet irradiation setting at least specifying which of the independent light source parts is turned on.

8. The printing apparatus according to claim 7, wherein each of the independent light source parts comprises a UVLED as a light source for generating ultraviolet rays.

9. The printing apparatus according to claim 1, wherein the printing apparatus is a flat bed type printing apparatus.

10. A printing method for printing in an ink jet method, using:

an ink jet head for ejecting ink droplets of an ultraviolet curing type ink, which is ink cured by ultraviolet rays, toward a medium;

a temporary curing ultraviolet light source which is an ultraviolet light source for irradiating ultraviolet rays to dots of ink formed of ink droplets landed to the medium, the temporary curing ultraviolet light source generating ultraviolet rays for curing the dots of the ink in a temporarily cured state;

an irradiation setting storage section which stores ultraviolet irradiation settings indicating irradiation settings of ultraviolet rays from the temporary curing ultraviolet light source to the medium; and a curing completion ultraviolet light source for further irradiating ultraviolet rays to the dots of the ink in the temporarily cured state to complete curing of the dots of the ink;

the printing method comprising:

making the ink jet head perform a main scanning operation for ejecting ink droplets while moving in a preset main scanning direction and thereby ink droplets are ejected to the medium;

performing a printing to the medium by a multi-pass method which performs a plurality of the main scanning operations for respective positions of a printing region to be printed on the medium;

in each of the plurality of the main scanning operations, irradiating ultraviolet rays to dots of the ink on the medium by the temporary curing ultraviolet light source based on the ultraviolet irradiation settings stored in the irradiation setting storage section; and using the ultraviolet irradiation setting which is set so that, regarding temperature of the region where the ink jet head ejects ink droplets in each of the plurality of the main scanning operations in the multi-pass method, an increasing range of temperature compared with temperature at a timing of the last main scanning operation is suppressed within a temperature rising range which dot gains of the dots of the ink are substantially the same as each other.

* * * * *